US012331668B1

(12) United States Patent
Ozeki et al.

(10) Patent No.: US 12,331,668 B1
(45) Date of Patent: Jun. 17, 2025

(54) VARIABLE VALVE DEVICE

(71) Applicant: SUZUKI MOTOR CORPORATION, Hamamatsu (JP)

(72) Inventors: Hisashi Ozeki, Hamamatsu (JP); Yuuta Kagawa, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 0 days.

(21) Appl. No.: 18/951,001

(22) Filed: Nov. 18, 2024

(30) Foreign Application Priority Data

Dec. 1, 2023 (JP) ..... 2023-203518

(51) Int. Cl.

| | |
|---|---|
| ***F01M 9/10*** | (2006.01) |
| ***F01L 1/053*** | (2006.01) |
| ***F01L 1/18*** | (2006.01) |
| *F01L 1/26* | (2006.01) |
| *F01L 13/00* | (2006.01) |

(52) U.S. Cl.
CPC ..... *F01M 9/108* (2013.01); *F01L 1/053* (2013.01); *F01L 1/181* (2013.01); *F01M 9/102* (2013.01); *F01M 9/105* (2013.01); *F01L 2001/0535* (2013.01); *F01L 2001/186* (2013.01); *F01L 1/267* (2013.01); *F01L 13/0036* (2013.01); *F01L 2810/02* (2013.01); *F01M 9/103* (2013.01); *F01M 9/107* (2013.01)

(58) Field of Classification Search
CPC ... F01L 1/053; F01L 2001/0535; F01L 1/181; F01L 2001/186; F01L 1/267; F01L 13/0036; F01L 2810/02; F01M 9/102; F01M 9/103; F01M 9/105; F01M 9/107; F01M 9/108
USPC ..... 123/90.16, 90.27, 90.34, 90.36, 90.38, 123/90.4, 90.44
See application file for complete search history.

(56) References Cited

U.S. PATENT DOCUMENTS

| | | | | |
|---|---|---|---|---|
| 4,928,641 | A * | 5/1990 | Niizato | F01L 13/00 123/90.16 |
| 2020/0157984 | A1* | 5/2020 | Emmersberger | F01L 13/0036 |
| 2021/0199031 | A1* | 7/2021 | Okamoto | F01M 9/105 |

FOREIGN PATENT DOCUMENTS

| | | | | |
|---|---|---|---|---|
| DE | 102015216401 | A1 * | 3/2017 | |
| EP | 1722075 | A1 * | 11/2006 | F01L 1/0532 |
| EP | 2853700 | A1 * | 4/2015 | F01L 13/0036 |
| JP | 5907552 | B2 | 4/2016 | |

* cited by examiner

*Primary Examiner* — Jorge L Leon, Jr.
(74) *Attorney, Agent, or Firm* — Stein IP, LLC

(57) ABSTRACT

A variable valve device includes a pair of cam housings separated from each other in a predetermined direction, a pair of rocker shafts supported by the pair of cam housings, a plurality of rocker arms supported by the pair of rocker shafts in a swingable manner, a switching mechanism that couples and separates intake arms, and an upper housing on the pair of cam housings. The upper housing is formed with a first injection hole for supplying lubrication oil to the switching mechanism and a second injection hole for supplying lubrication oil to the rocker arms. A passage length from a lubrication groove around a camshaft to the second injection hole is larger than a passage length from the lubrication groove to the first injection hole.

7 Claims, 15 Drawing Sheets

VARIABLE VALVE DEVICE

CROSS-REFERENCE TO RELATED APPLICATION(S)

This application is based on and claims priority under 35 USC 119 from Japanese Patent Application No. 2023-203518 filed on Dec. 1, 2023, the entire content of which is incorporated herein by reference.

TECHNICAL FIELD

The present invention relates to a variable valve device.

BACKGROUND ART

In the related art, there is known a variable valve device in which a plurality of rocker arms are coupled to one another to switch a valve operation (for example, see Patent Literature 1). In the variable valve device described in Patent Literature 1, a pair of rocker arms are installed adjacent to each other, and a coupling pin is installed in a pin hole of one rocker arm. A part of the coupling pin is pushed into a pin hole of the other rocker arm to couple the pair of rocker arms, and the part of the coupling pin is pulled out of the pin hole of the other rocker arm to separate the pair of rocker arms. A valve lift cam is switched by switching coupling and separation of the pair of rocker arms.

CITATION LIST

Patent Literature

Patent Literature 1: JP5907552B

The variable valve device described above also requires lubrication, but a lubrication passage is complicated when the number of components to be lubricated increases. Due to the increase in the number of components to be lubricated and the complication of the lubrication passage, it may be difficult to appropriately supply lubrication oil to each component, and durability may be lowered.

SUMMARY

The present invention is made in view of the above circumstance, and an object of the present invention is to provide a variable valve device capable of improving lubricity of each component by appropriately supplying lubrication oil to each component.

In order to solve the above problem, a variable valve device according to one aspect of the present invention is a variable valve device configured to change a valve operation in a cylinder head. The variable valve device includes a pair of cam housings separated from each other in a predetermined direction in the cylinder head, a camshaft supported by the cylinder head and the pair of cam housings, a pair of rocker shafts supported by opposing portions of the pair of cam housings, a plurality of rocker arms supported by the pair of rocker shafts in a swingable manner, a switching mechanism that couples and separates intake arms among the plurality of rocker arms, and an upper housing supported at both ends on upper surfaces of the pair of cam housings, in which the upper housing is formed with a first injection hole for supplying lubrication oil to the switching mechanism and a second injection hole for supplying lubrication oil to the plurality of rocker arms, and the lubrication oil is pressure-fed from a lubrication groove around the camshaft to the first injection hole and the second injection hole, and a passage length from the lubrication groove to the second injection hole is larger than a passage length from the lubrication groove to the first injection hole.

According to the variable valve device in the one aspect of the present invention, since the passage length from the lubrication groove around the camshaft to the second injection hole is larger than the passage length from the lubrication groove to the first injection hole, oil pressure in a lubrication passage that communicates with the first injection hole on the switching mechanism side is increased. Even when the number of components to be lubricated is increased due to the switching mechanism, an appropriate amount of lubrication oil is supplied from the first injection hole to the switching mechanism, and an appropriate amount of lubrication oil is supplied from the second injection hole to the plurality of rocker arms. Therefore, components of the switching mechanism and the rocker arms are appropriately lubricated.

DESCRIPTION OF EMBODIMENTS

A variable valve device according to one aspect of the present invention changes a valve operation in a cylinder head. In the cylinder head, a pair of cam housings are separated from each other in a predetermined direction, and a camshaft is supported by the cylinder head and the pair of cam housings. An upper housing is supported at both ends on upper surfaces of the pair of cam housings. A rocker shaft is supported by opposing portions of the pair of cam housings, and a plurality of rocker arms are supported in a swingable manner by the rocker shaft. Among the plurality of rocker arms, intake arms are coupled and separated by a switching mechanism. The upper housing is formed with a first injection hole for supplying lubrication oil to the switching mechanism and a second injection hole for supplying lubrication oil to the plurality of rocker arms. The lubrication oil is pressure-fed from a lubrication groove around the camshaft to the first injection hole and the second injection hole. A passage length from the lubrication groove around the camshaft to the second injection hole is larger than a passage length from the lubrication groove to the first injection hole, and oil pressure in a lubrication passage that communicates with the first injection hole on the switching mechanism side is increased. Even when the number of components to be lubricated is increased due to the switching mechanism, an appropriate amount of lubrication oil is supplied from the first injection hole to the switching mechanism, and an appropriate amount of lubrication oil is supplied from the second injection hole to the plurality of rocker arms. Therefore, components of the switching mechanism and the rocker arms are appropriately lubricated.

EMBODIMENT

Figure 1:
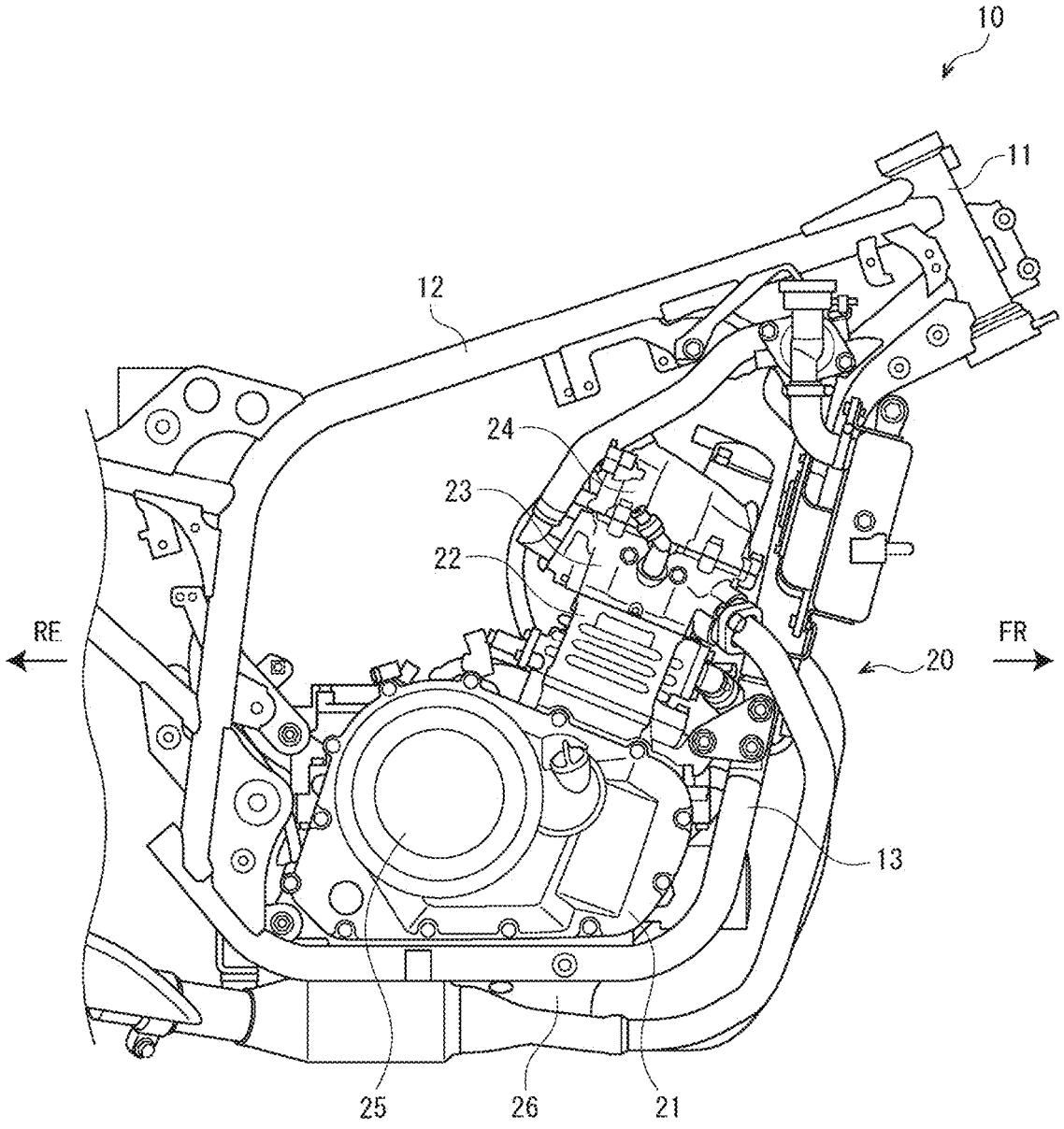
FIG. 1 is a right side view showing an engine and a vehicle body frame according to an embodiment.
Figure 2:
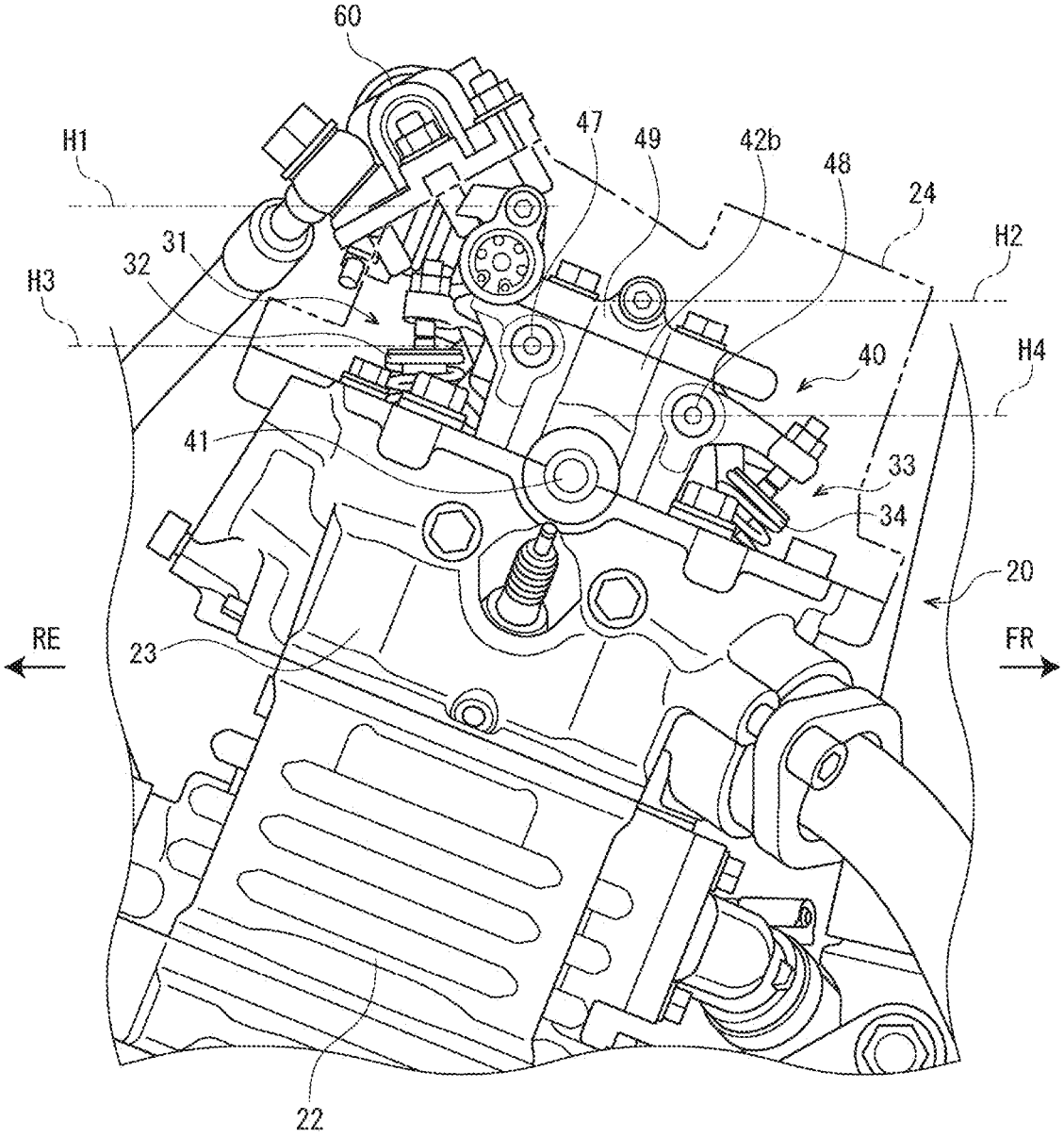
FIG. 2 is a right side view showing an upper portion of the engine from which a cylinder head cover is removed according to the present embodiment.
Figure 3:
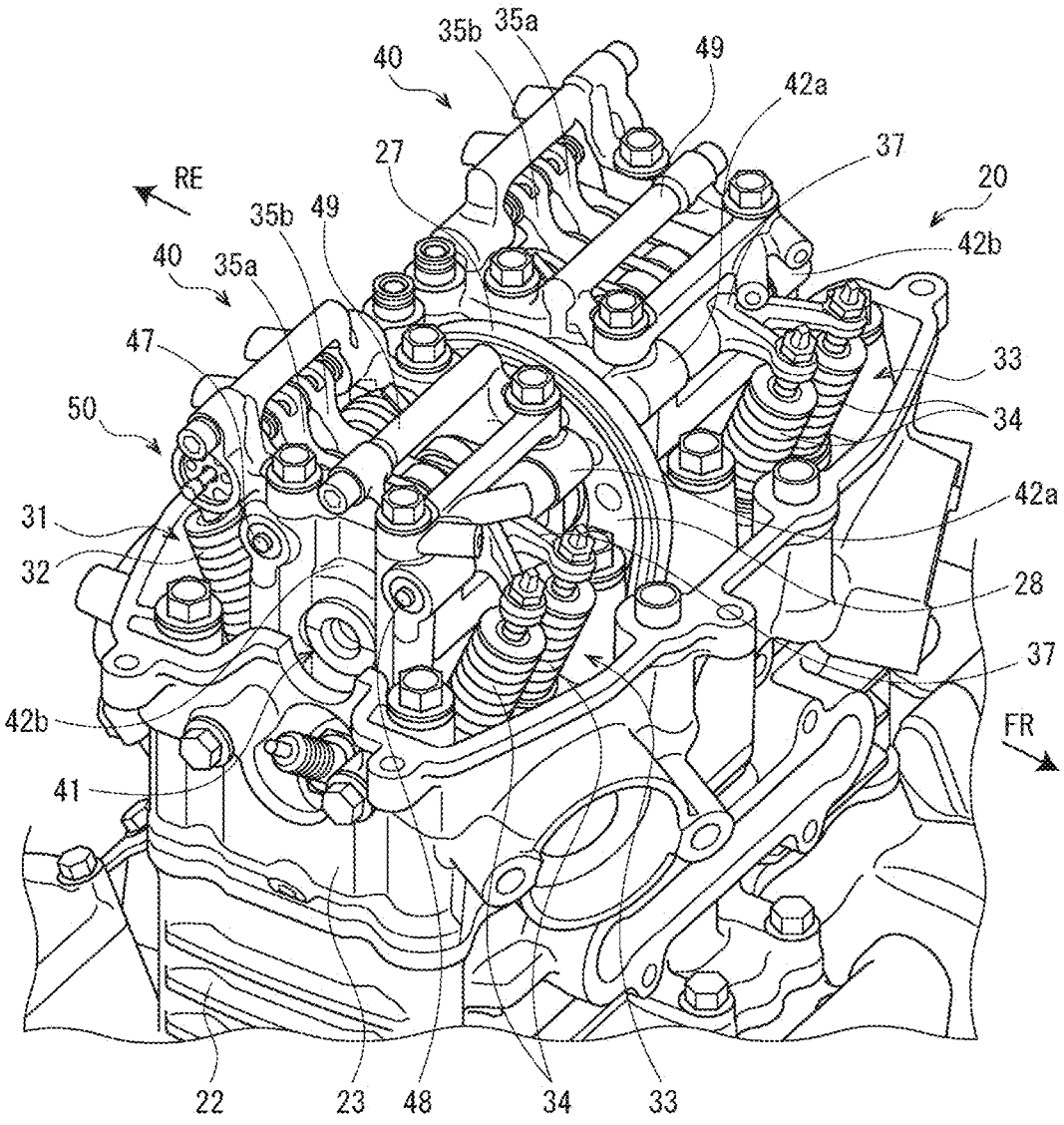
FIG. 3 is a perspective view showing the upper portion of the engine from which the cylinder head cover is removed according to the present embodiment.
Figure 4:
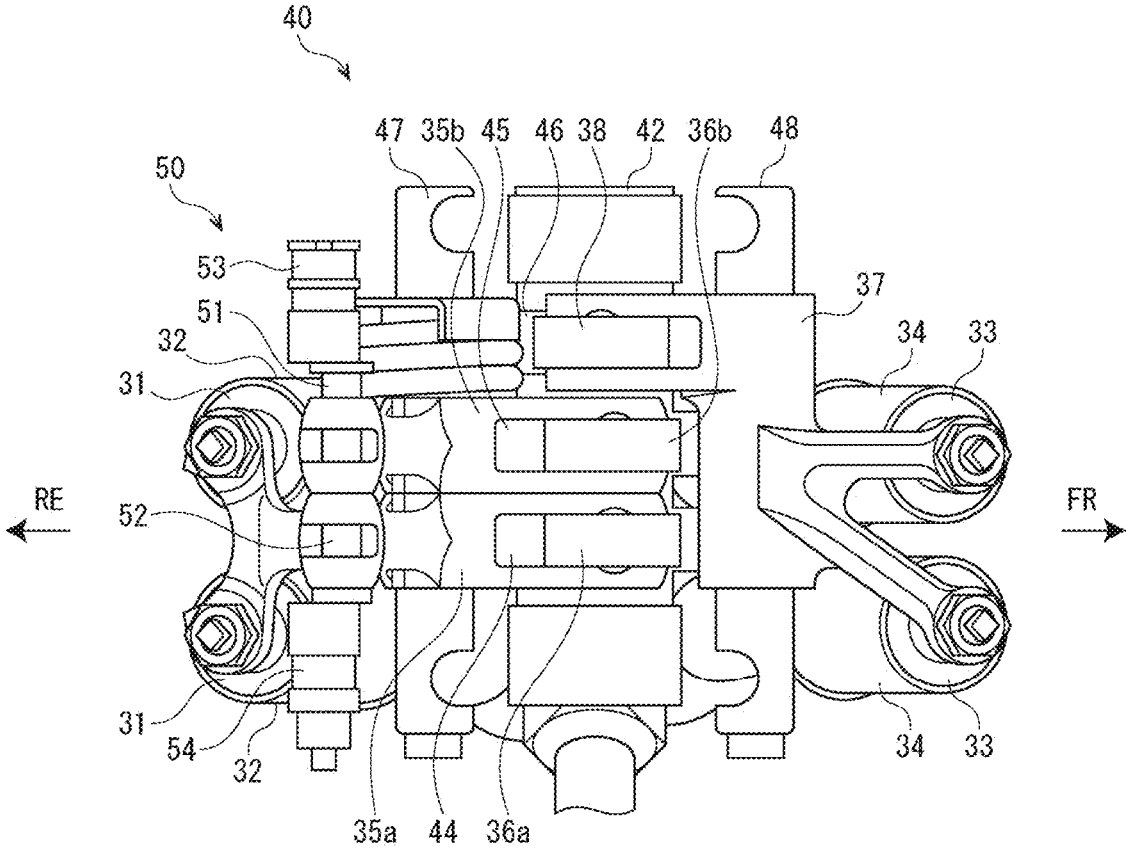
FIG. 4 is a schematic top view showing a variable valve device according to the present embodiment.

Hereinafter, an embodiment will be described in detail with reference to the accompanying drawings. FIG. 1 is a right side view showing an engine and a vehicle body frame according to the present embodiment. FIG. 2 is a right side view showing an upper portion of the engine from which a cylinder head cover is removed according to the present embodiment. FIG. 3 is a perspective view showing the upper portion of the engine from which the cylinder head cover is removed according to the present embodiment. FIG. 4 is a schematic top view showing a variable valve device according to the present embodiment. In the following drawings, an arrow FR indicates a vehicle front side, an arrow RE indicates a vehicle rear side, an arrow L indicates a vehicle left side, and an arrow R indicates a vehicle right side. In FIG. 3, an oil control valve is omitted.

As shown in FIG. 1, a straddle-type vehicle includes various components such as an engine 20 and an electrical system mounted on a cradle type vehicle body frame 10. The vehicle body frame 10 includes a main tube 12 that extends rearward from an upper portion of a head pipe 11 and then is bent downward, and a down tube 13 that extends downward from a lower portion of the head pipe 11 and then is bent rearward. A rear end portion of the down tube 13 is joined to a lower end portion of the main tube 12 to form an installation space for the engine 20 inside the vehicle body frame 10. The main tube 12 supports a rear side of the engine 20, and the down tube 13 supports a front side and a lower side of the engine 20.

The engine 20 includes a crankcase 21, a cylinder 22 provided on the crankcase 21, a cylinder head 23 provided on the cylinder 22, and a cylinder head cover 24 provided on the cylinder head 23. A clutch cover 25 that covers a clutch (not shown) from a side is attached to a right side surface of the crankcase 21. A magnet cover (not shown) that covers a magnet (not shown) from a side is attached to a left side surface of the crankcase 21. An oil pan 26 that stores oil is attached to a lower surface of the crankcase 21.

As shown in FIGS. 2 and 3, the engine 20 is a four-valve two-cylinder engine, and a cam chain 27 is installed between the two cylinders. The cam chain 27 is wound around a cam sprocket 28, and a variable valve device 40 is installed for each of left and right cylinders across the cam sprocket 28. The variable valve device 40 is provided with a camshaft 41 that rotates integrally with the cam sprocket 28. Cam housings 42*a* and 42*b* are provided for each cylinder in the cylinder head 23 in a manner of being separated from each other in a left-right direction (a predetermined direction), and the camshaft 41 is rotatably supported by mating surfaces of the cam housings 42*a* and 42*b* and the cylinder head 23.

In the cylinder head 23, four intake valves 31 are installed in rear of the camshaft 41, and four exhaust valves 33 are installed in front of the camshaft 41. The intake valve 31 is pressed in a valve closing direction by a valve spring 32, and the exhaust valve 33 is pressed in a valve closing direction by a valve spring 34. A low-speed cam 44, a high-speed cam 45, and an exhaust cam 46 (see FIG. 4) are formed on an outer circumferential surface of the camshaft 41. Each of the cams 44 to 46 is formed in a plate shape in which a cam ridge protrudes from a part of a base circle. A cam ridge of the high-speed cam 45 is higher than that of the low-speed cam 44 in order to make a valve lift amount of the high-speed cam 45 larger than that of the low-speed cam 44.

An intake rocker shaft 47 and an exhaust rocker shaft 48 are supported by opposing portions of the cam housings 42*a* and 42*b*. The intake rocker shaft 47 and the exhaust rocker shaft 48 are positioned above the camshaft 41, and the intake rocker shaft 47 and the exhaust rocker shaft 48 extend parallel to the camshaft 41. An upper housing 49 is supported at both ends on upper surfaces of the cam housings 42*a* and 42*b*, and a hydraulic piston 53 and a spring pin 54 (see FIG. 4) are accommodated in the upper housing 49. An oil control valve 60 (not shown in FIG. 3) is installed in rear of an upper surface of the cylinder head cover 24.

As shown in FIG. 4, the intake rocker shaft 47 is positioned in the rear of the camshaft 41, and the exhaust rocker shaft 48 is positioned in front of the camshaft 41. Two types of intake rocker arms 35*a* and 35*b* (only one is shown in FIG. 4) are supported in a swingable manner by the intake rocker shaft 47, and an exhaust rocker arm 37 (only one is shown in FIG. 4) is supported in a swingable manner by the exhaust rocker shaft 48. The intake rocker arm 35*a* and the exhaust rocker arm 37 are formed in a seesaw shape having a point of effort and a point of load, and the intake rocker arm 35*b* is formed to be the point of effort of the intake rocker arm 35*a*.

A roller 36*a* that is in rolling contact with the low-speed cam 44 is supported in a rotatable manner at one end of the intake rocker arm 35*a*, and a pair of the intake valves 31 are coupled to the other end of the intake rocker arm 35*a* which is bifurcated. A roller 36*b* that is in rolling contact with the high-speed cam 45 is supported in a rotatable manner at one end of the intake rocker arm 35*b*, and the intake valves 31 are not coupled to the other end of the intake rocker arm 35*b*. A roller 38 that is in rolling contact with the exhaust cam 46 is supported in a rotatable manner at one end of the exhaust rocker arm 37, and a pair of the exhaust valves 33 are coupled to the other end of the exhaust rocker arm 37 which is bifurcated. The intake rocker arms 35*a* and 35*b* are formed in a manner capable of being coupled to each other.

When an engine rotates at a low-speed and a medium speed, the intake rocker arms 35*a* and 35*b* are not coupled. Therefore, the intake rocker arm 35*a* is swung by the low-speed cam 44, and the intake rocker arm 35*b* is swung by the high-speed cam 45. Since the pair of intake valves 31 are coupled to the intake rocker arm 35*a*, the pair of intake valves 31 are moved in response to rotation of the low-speed cam 44. Since the cam ridge of the low-speed cam 44 is small, valve lift amounts of the pair of intake valves 31 are small. Since the intake valves 31 are not coupled to the intake rocker arm 35*b*, the intake rocker arm 35*b* is idle in response to rotation of the high-speed cam 45.

When the engine rotates at a high-speed, the intake rocker arms 35*a* and 35*b* are coupled to each other. Therefore, the intake rocker arms 35*a* and 35*b* are swung integrally by the high-speed cam 45. Since the pair of intake valves 31 are coupled to the intake rocker arm 35*b* via the intake rocker arm 35*a*, the pair of intake valves 31 are moved in response to rotation of the high-speed cam 45. Since the cam ridge of the high-speed cam 45 is large, valve lift amounts of the pair of intake valves 31 are large. In this manner, the low-speed cam 44 and the high-speed cam 45 that move the intake valves 31 are switched by switching a coupling state of the intake rocker arms 35*a* and 35*b*.

Each variable valve device 40 is provided with a switching mechanism 50 that couples and separates the intake rocker arms 35*a* and 35*b*. The switching mechanism 50 is provided with a coupling pin 51 installed in a storage chamber of the intake rocker arm 35*b* and a return pin 52 installed in a storage chamber of the intake rocker arm 35*a*. The switching mechanism 50 is provided with the hydraulic piston 53 that is in contact with the coupling pin 51 from one side in a left-right direction, and the spring pin 54 that is in contact with the return pin 52 from the other side in the left-right direction. The hydraulic piston 53 can be moved forward and backward by oil pressure, and the spring pin 54 can be moved forward and backward by expansion and contraction of a spring.

When hydraulic oil is supplied to the hydraulic piston 53, the hydraulic piston 53 is moved forward against a spring force of the spring pin 54. As the hydraulic piston 53 is moved forward, the return pin 52 is pushed by the coupling pin 51, and a part of the coupling pin 51 enters the storage chamber of the intake rocker arm 35*a* from the storage chamber of the intake rocker arm 35*b* to couple the intake rocker arms 35*a* and 35*b*. When the hydraulic oil is discharged from the hydraulic piston 53, the hydraulic piston 53 is moved backward by the spring force of the spring pin 54. As the hydraulic piston 53 is moved backward, the coupling pin 51 is pushed back by the return pin 52, and a part of the coupling pin 51 is pulled out of the storage chamber of the intake rocker arm 35*a* to separate the intake rocker arms 35*a* and 35*b*.

Lubrication oil is supplied from the crankcase 21 toward the variable valve device 40 through a gap between a head bolt and a bolt hole. In the variable valve device 40, the lubrication oil is pressure-fed to respective components to be lubricated through lubrication grooves around the camshaft 41. The upper housing 49 is formed with an injection hole opened to the atmosphere for each component to be lubricated. Lubrication passages extend in two directions from the lubrication groove, the lubrication oil is fed to injection holes for stem ends of the intake valves 31 and injection holes for the switching mechanism 50 through one of the lubrication passages, and the lubrication oil is fed to injection holes for stem ends of the exhaust valves 33 and injection holes for the rocker arms 35*a*, 35*b*, and 37 through the other lubrication passage.

At this time, the one lubrication passage is provided with two injection holes for the stem ends of the intake valves 31 and five injection holes for the switching mechanism 50. The other lubrication passage is provided with two injection holes for the stem ends of the exhaust valves 33 and three injection holes for the rocker arms 35*a*, 35*b*, and 37. Since these injection holes are formed to have the same diameter, a total area of the injection holes opened to the atmosphere in the one lubrication passage is larger than a total area of the injection holes opened to the atmosphere in the other lubrication passage. The injection holes for the stem ends of the intake valves 31 and the injection holes for the switching mechanism 50 are formed in the one lubrication passage at a highest position H1 (see FIG. 2) in a side view.

Therefore, when a passage length of the one lubrication passage is substantially the same as a passage length of the other lubrication passage, or when the passage length of the one lubrication passage is larger than the passage length of the other lubrication passage, oil pressure in the one lubrication passage is reduced. A supply amount of the lubrication oil from the injection holes for the stem ends of the intake valves 31 or the switching mechanism 50 is reduced, and particularly at the time of high oil temperature and low rotation, the lubrication oil is not injected from the injection holes, and these components cannot be appropriately lubricated. In the present embodiment, a lubrication passage in the camshaft 41 is used to increase the passage length of the other lubrication passage, thereby increasing the oil pressure in the one lubrication passage to appropriately lubricate the stem end of the intake valve 31 or the switching mechanism 50.

Figure 5:
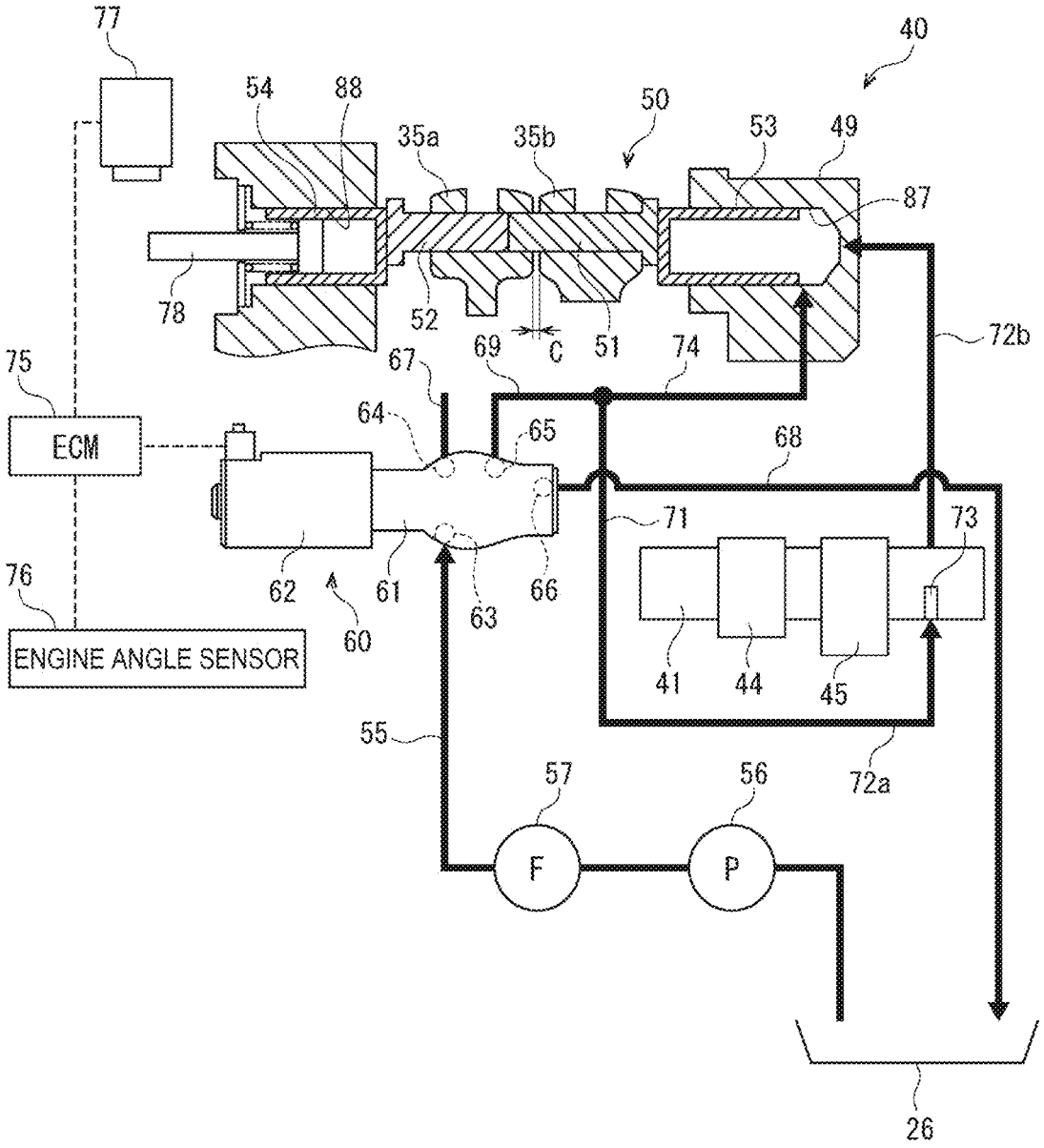
FIG. 5 is a schematic view showing the variable valve device according to the present embodiment.

The variable valve device will be described with reference to FIG. 5. FIG. 5 is a schematic diagram showing the variable valve device according to the present embodiment.

As shown in FIG. 5, in the variable valve device 40, an oil supply path 55 extends from the oil pan 26 toward the oil control valve 60. Oil is pumped up from the oil pan 26 by an oil pump 56 provided in an intermediate portion of the oil supply path 55, and the oil is supplied to the oil control valve 60 through an oil filter 57. The oil control valve 60 is formed by a valve housing 61 in which a valve spool (not shown) is accommodated, and a solenoid 62 that moves the valve spool forward and backward. When the valve spool is moved forward and backward by the solenoid 62, an oil passage in the oil control valve 60 is switched.

An input port 63, a low-speed port 64, a high-speed port 65, and a drain port 66 are formed in the valve housing 61. The oil supply path 55 communicates with the input port 63, a dead end passage 67 communicates with the low-speed port 64, a switching passage 69 communicates with the high-speed port 65, and a drain passage 68 communicates with the drain port 66. A discharge destination of the dead end passage 67 is closed, and the switching passage 69 extends from the oil control valve 60 toward the switching mechanism 50. The drain passage 68 extends from the oil control valve 60 to a position above the oil pan 26, and oil is dropped from an outlet of the drain passage 68 to the oil pan 26.

By moving the valve spool of the oil control valve 60, the input port 63 communicates with one of the low-speed port 64 and the high-speed port 65, and the drain port 66 communicates with the other one of the low-speed port 64 and the high-speed port 65. Oil is output from the oil control valve 60 to one of the dead end passage 67 and the switching passage 69, and remaining oil is discharged from the other one of the dead end passage 67 and the switching passage 69 to the oil control valve 60 (the drain passage 68). In this manner, oil pressure applied to the switching mechanism 50 is controlled by the oil control valve 60.

The switching passage 69 is divided into an actuation passage 71 and a direct passage 74, and both the actuation passage 71 and the direct passage 74 extend from the oil control valve 60 to the hydraulic piston 53 of the switching mechanism 50. A part of the actuation passage 71 is formed by an oil groove 73 through which oil is allowed to pass at a predetermined rotation phase of the camshaft 41. As described above, the low-speed cam 44, the high-speed cam 45, and the exhaust cam 46 (not shown in FIGS. 6A and 6B) are formed on the camshaft 41, and the oil groove 73 is formed in a part of an outer circumferential surface of the camshaft 41.

The actuation passage 71 is divided into an upstream passage 72*a* and a downstream passage 72*b* with the oil groove 73 of the camshaft 41 interposed therebetween. By rotating the camshaft 41, communication and separation between the upstream passage 72*a* and the downstream passage 72*b* of the actuation passage 71 are alternately repeated. The direct passage 74 directly extends from the oil control valve 60 to the hydraulic piston 53 without passing through the oil groove 73 of the camshaft 41. After the hydraulic piston 53 is moved in response to oil supply through the actuation passage 71, the hydraulic piston 53 is maintained in a state in which the hydraulic piston 53 is pushed by oil supply through the direct passage 74. A predetermined rotation phase of the camshaft 41 is set from an end timing of a valve lift to a timing before the start of a subsequent valve lift.

The coupling pin 51 is installed in a storage hole in an upper portion of the intake rocker arm 35*b*, and the return pin 52 is installed in a storage hole in an upper portion of the intake rocker arm 35*a*. A tip end of the return pin 52 is in contact with a tip end of the coupling pin 51. The upper housing 49 is formed with a hydraulic chamber 87 and a storage chamber 88, the hydraulic piston 53 is installed in the hydraulic chamber 87, and the spring pin 54 is installed in the storage chamber 88. A pressing surface of the hydraulic piston 53 is in contact with the coupling pin 51, and a pressing surface of the spring pin 54 is in contact with the return pin 52. A sensing arm 78 extends from the spring pin 54 to the other side.

The switching mechanism 50 switches a coupling state of the intake rocker arms 35*a* and 35*b* by moving the coupling pin 51 by oil pressure. As described above, in a separation state of the intake rocker arms 35*a* and 35*b*, the pair of intake valves 31 are operated by the low-speed cam 44 via the intake rocker arms 35*a*. In a coupling state of the intake rocker arms 35*a* and 35*b*, the pair of intake valves 31 are operated by the high-speed cam 45 via the intake rocker arms 35*a* and 35*b*. In this manner, the switching mechanism 50 switches cams that move the pair of intake valves 31 by switching the coupling state of the intake rocker arms 35*a* and 35*b* by the coupling pin 51.

The variable valve device 40 is provided with an engine control module (ECM) 75, an engine angle sensor 76, and a switching sensor 77. The engine angle sensor 76 detects an engine rotation speed, when the engine rotation speed is a predetermined rotation speed or more, the ECM 75 outputs a coupling command signal to the solenoid 62, and when the engine rotation speed is less than the predetermined rotation speed, the ECM 75 outputs a release command signal to the solenoid 62. The switching sensor 77 detects switching between the coupling state and the separation state of the intake rocker arms 35*a* and 35*b* based on movement of a tip end of the sensing arm 78. A failure of the variable valve device 40 such as a defective switching operation can be determined by comparing a command signal from the ECM 75 and a detection signal from the switching sensor 77.

Figure 6A:
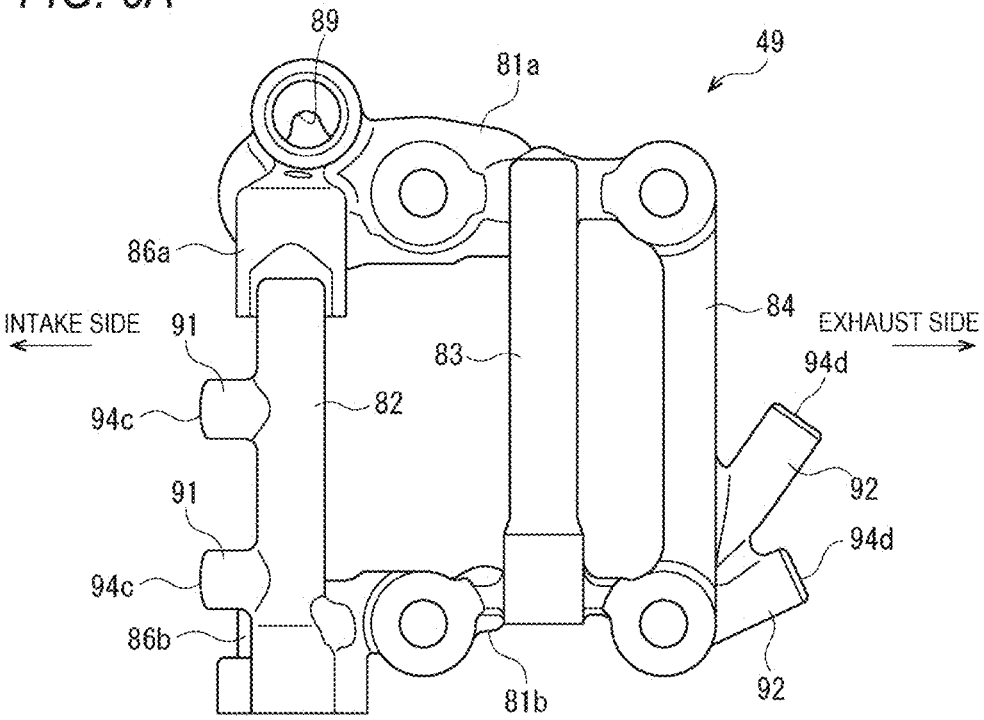
FIGS. 6A and 6B show a top view and a bottom view of an upper housing according to the present embodiment.
Figure 6B:
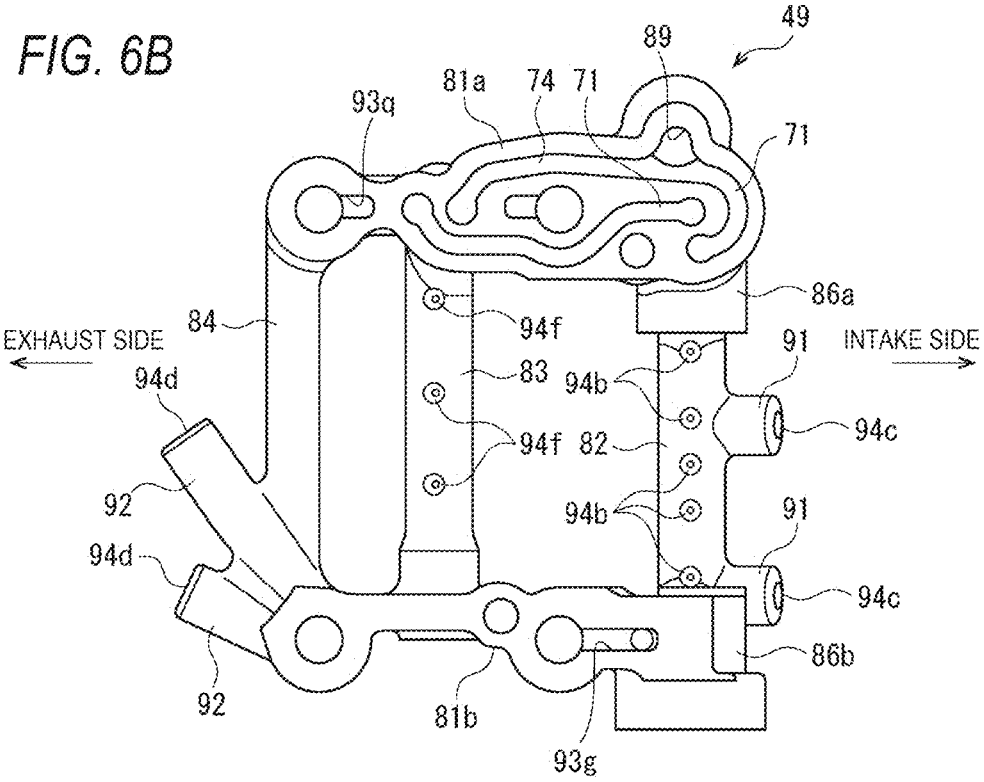
Figure 7:
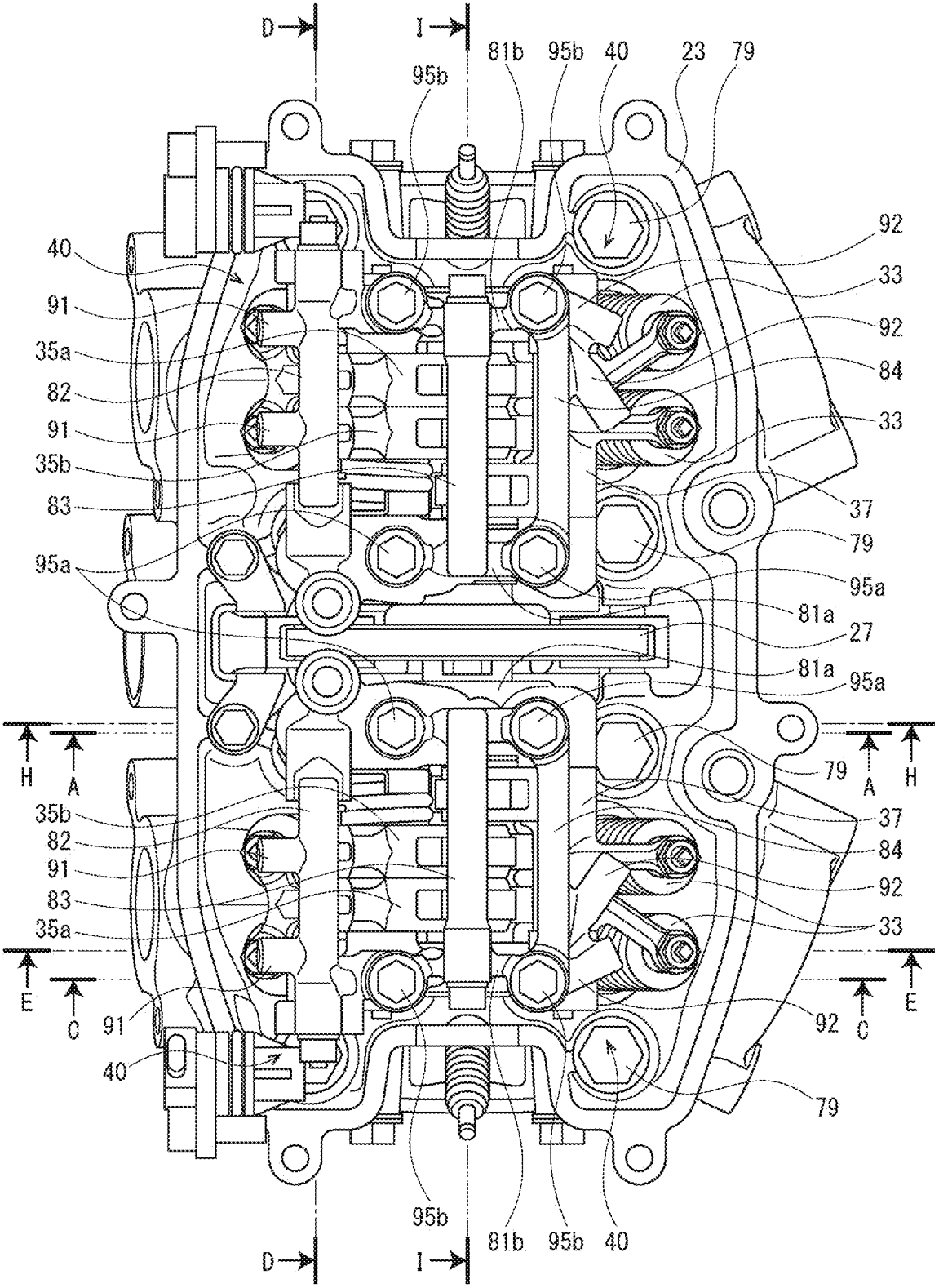
FIG. 7 shows a top view inside a cylinder head according to the present embodiment.
Figure 8:
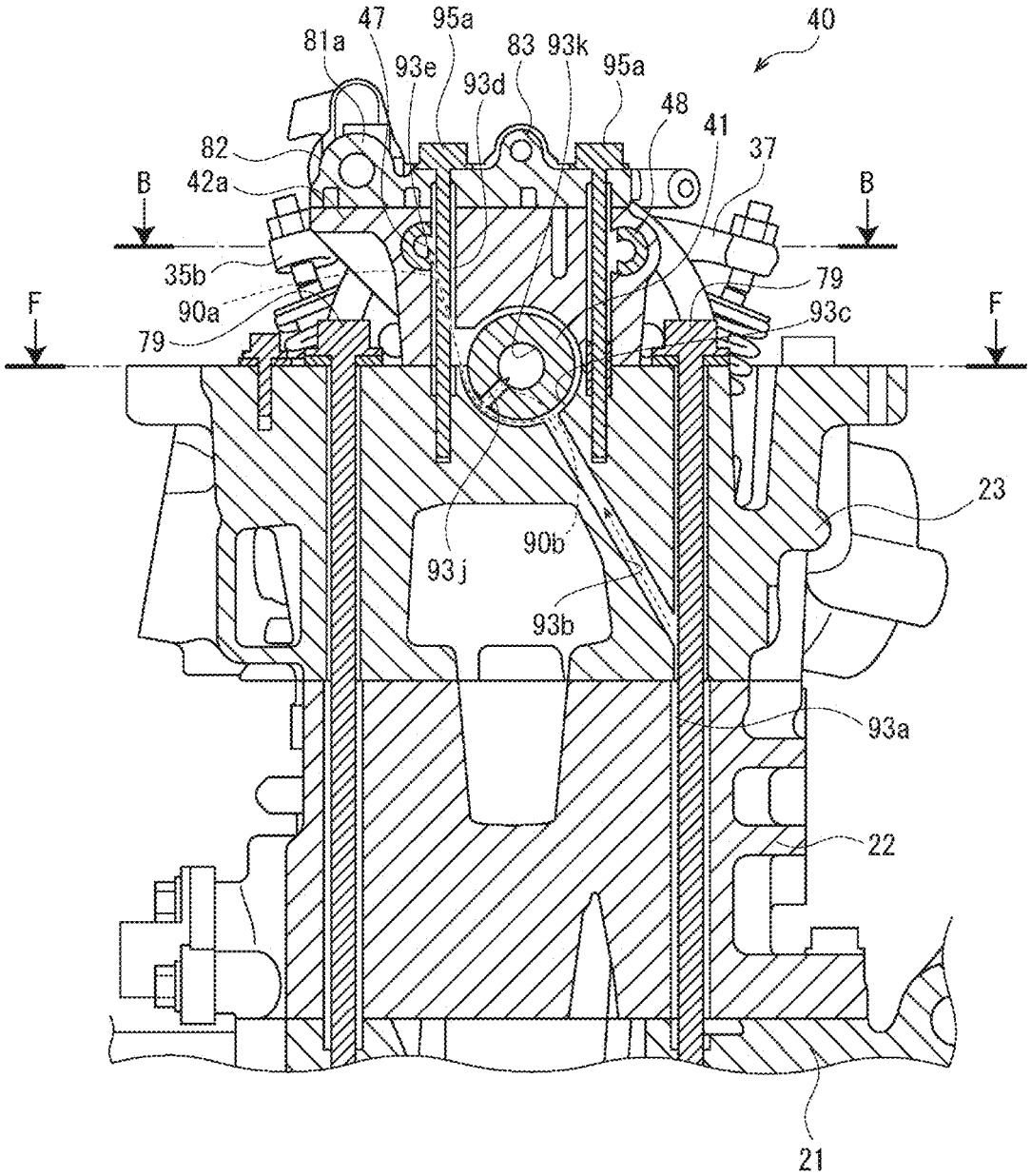
FIG. 8 is a cross-sectional view showing the cylinder head taken along a line A-A in FIG. 7.
Figure 9:
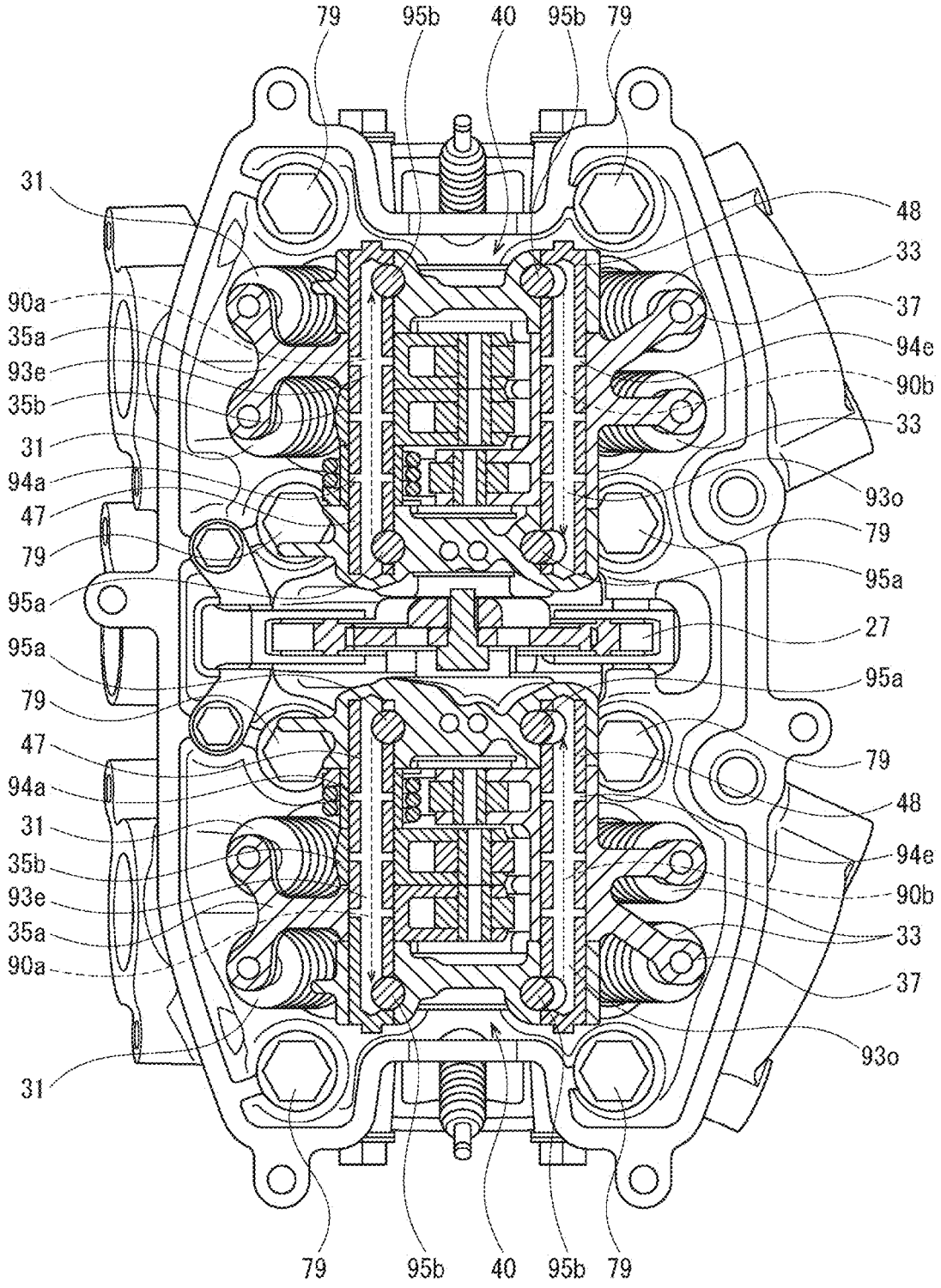
FIG. 9 is a cross-sectional view showing the cylinder head taken along a line B-B in FIG. 8.
Figure 10:
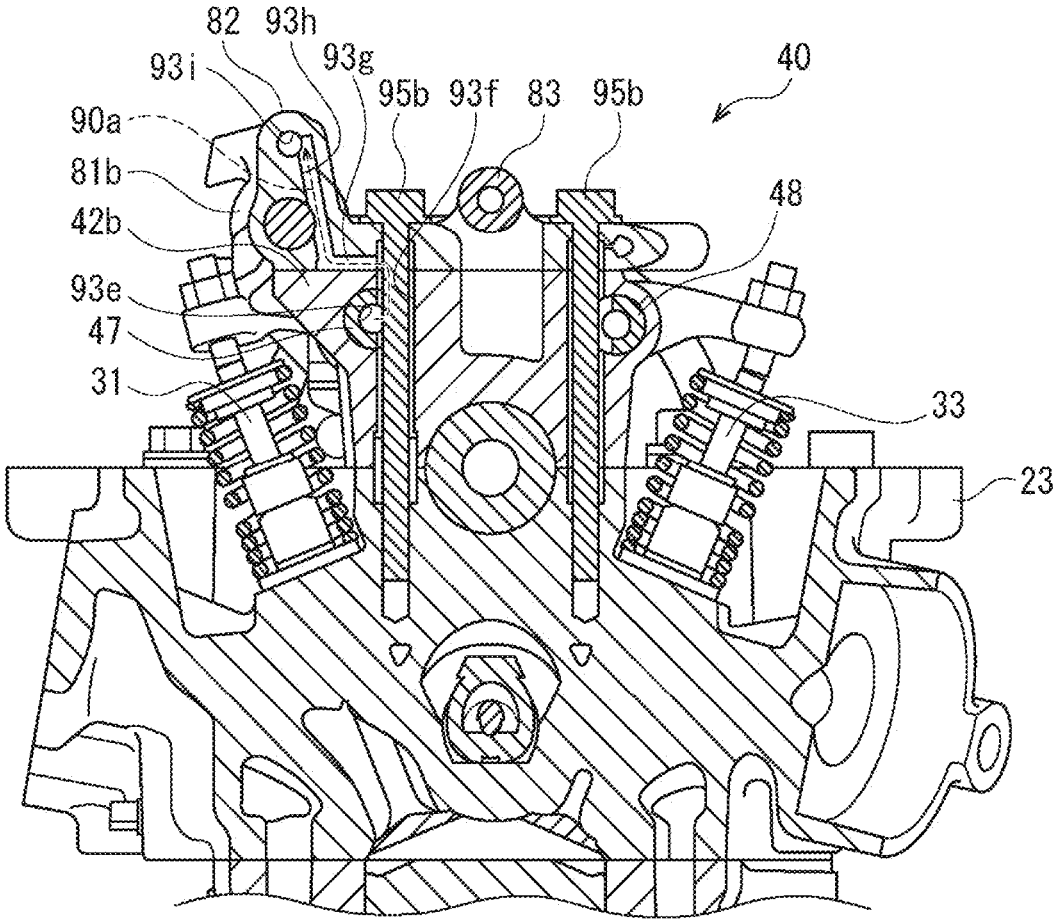
FIG. 10 is a cross-sectional view showing the cylinder head taken along a line C-C in FIG. 7.
Figure 11:
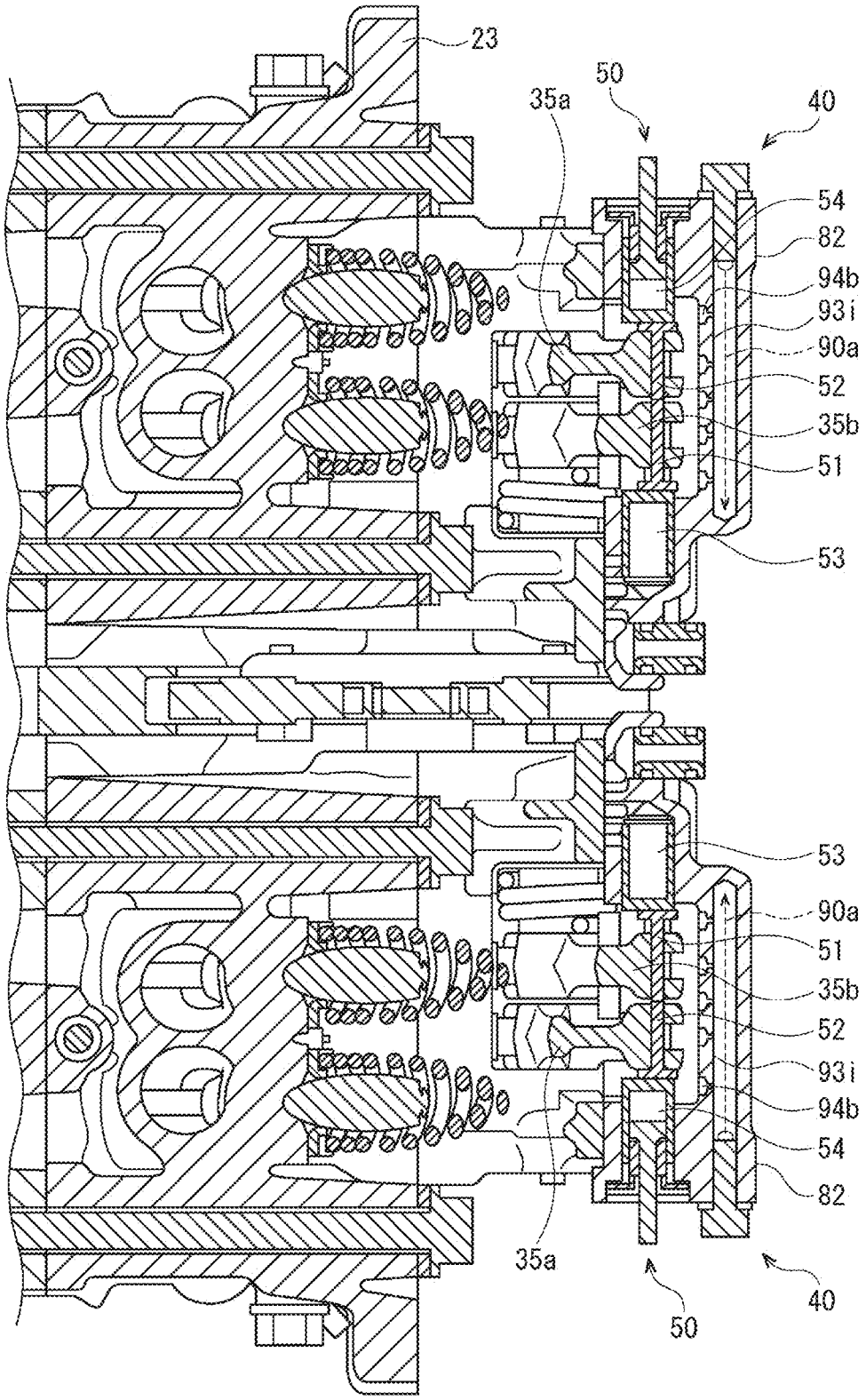
FIG. 11 is a cross-sectional view showing the cylinder head taken along a line D-D in FIG. 7.
Figure 12:
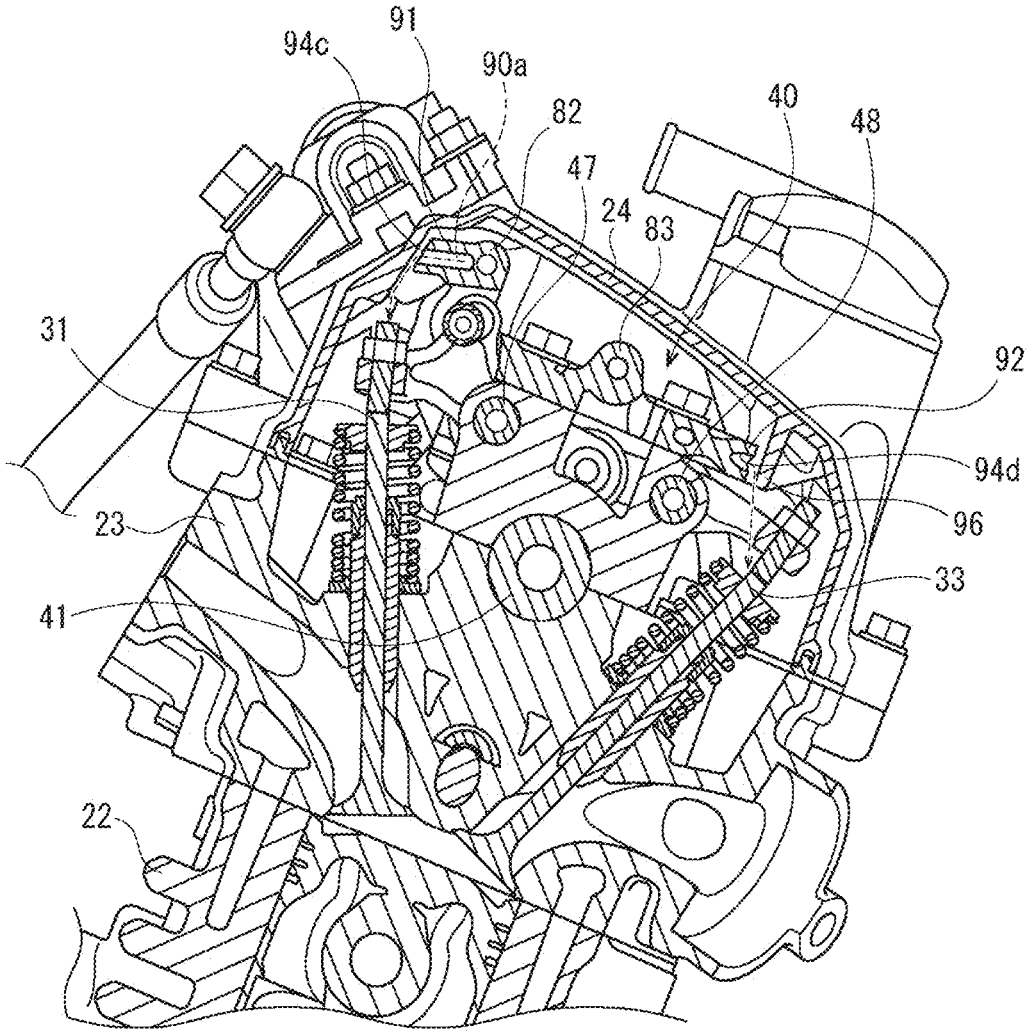
FIG. 12 is a cross-sectional view showing the cylinder head taken along a line E-E in FIG. 7.
Figure 13:
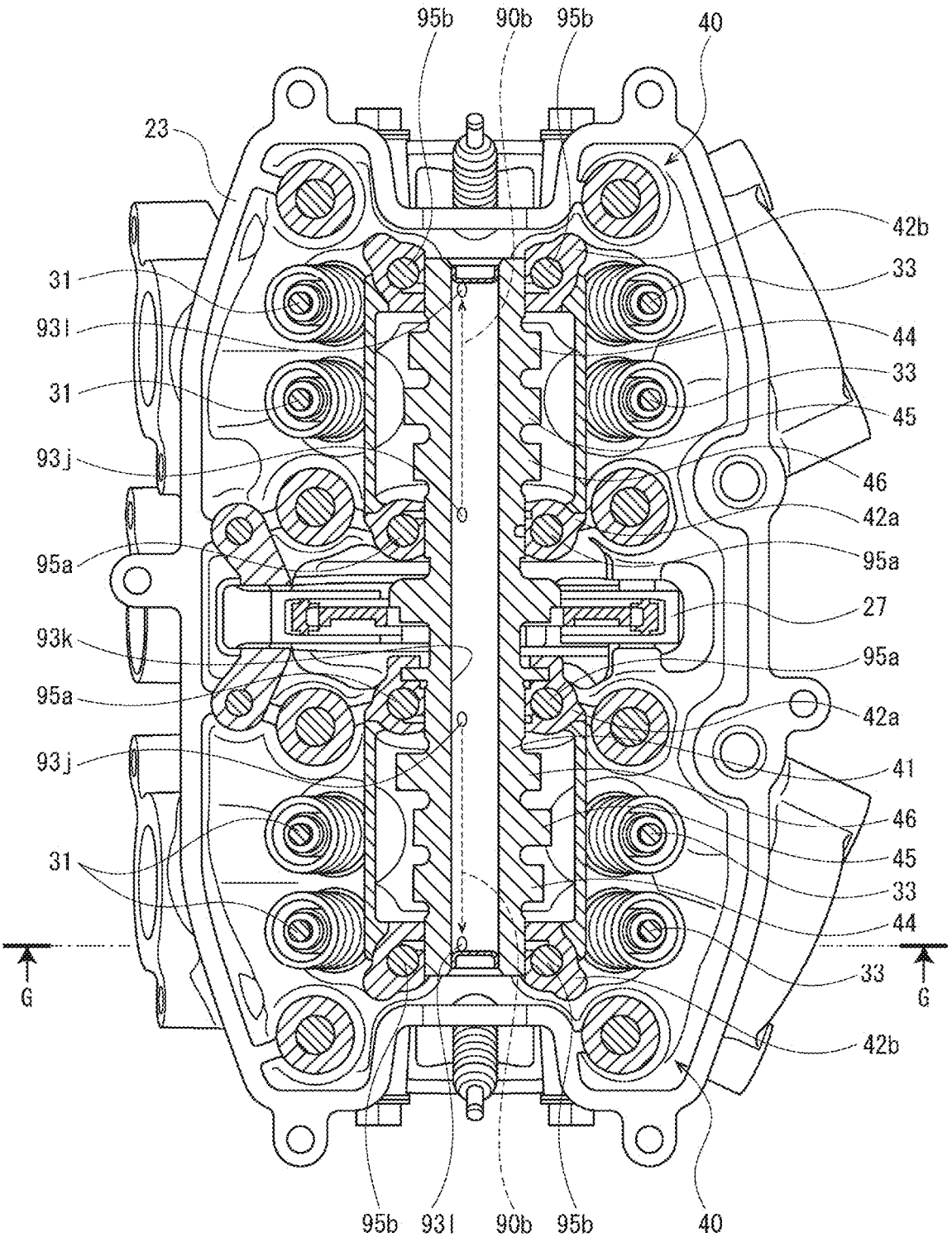
FIG. 13 is a cross-sectional view showing the cylinder head taken along a line F-F in FIG. 8.
Figure 14:
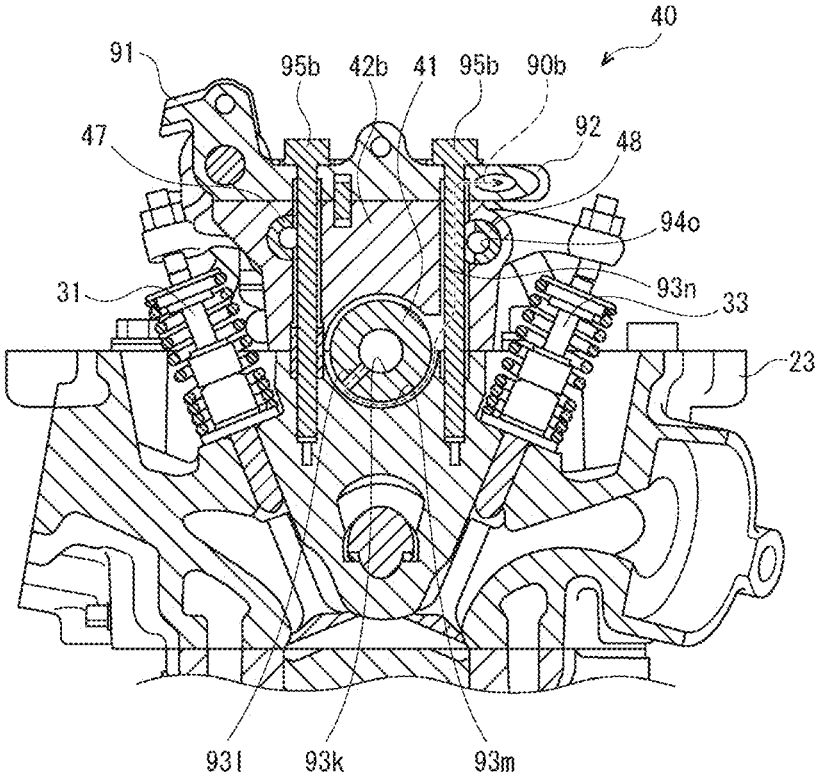
FIG. 14 is a cross-sectional view showing the cylinder head taken along a line G-G in FIG. 13.
Figure 15:
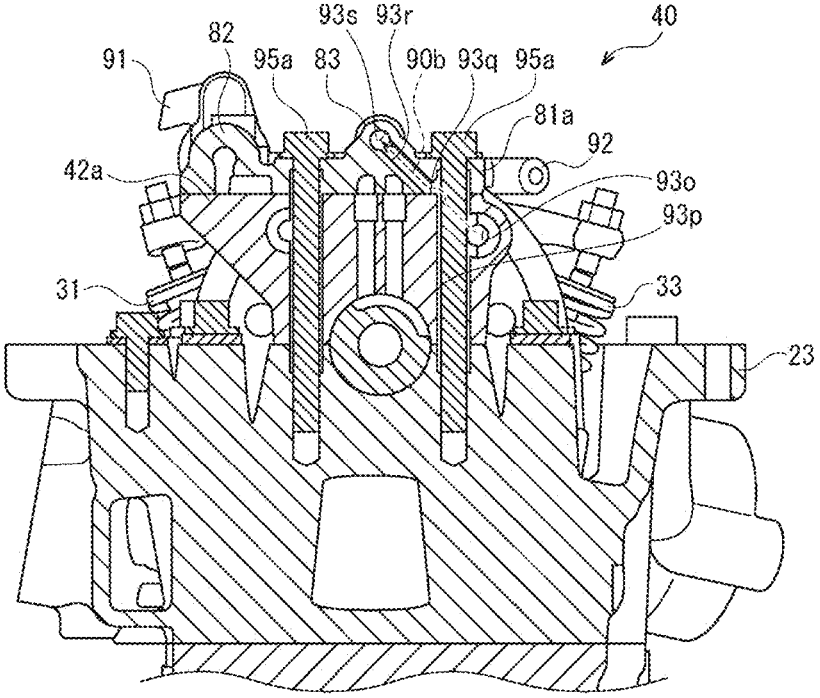
FIG. 15 is a cross-sectional view showing the cylinder head taken along a line H-H in FIG. 7.
Figure 16:
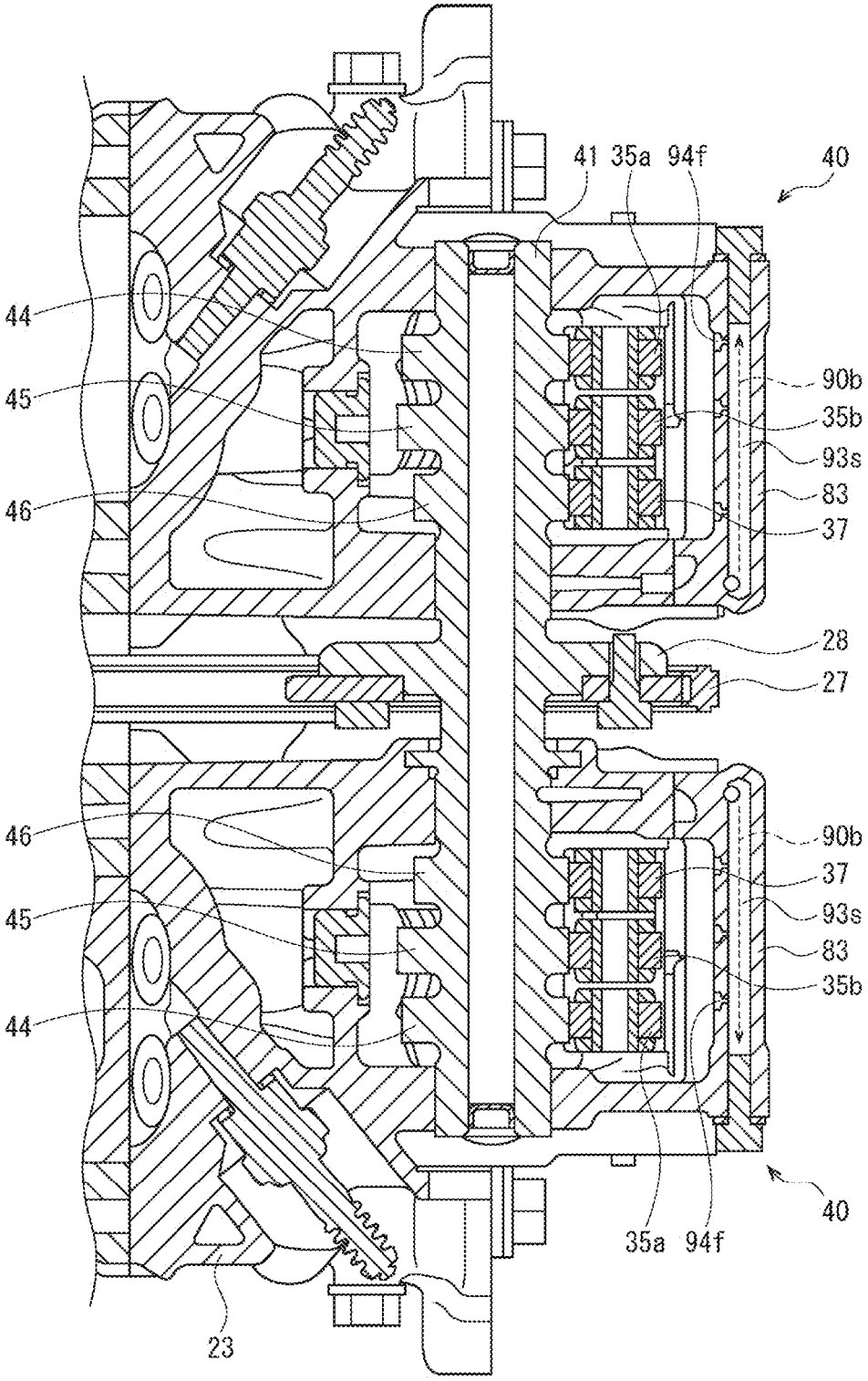
FIG. 16 is a cross-sectional view showing the cylinder head taken along a line I-I in FIG. 7.

Hereinafter, lubrication and hydraulic oil passages will be described with reference to FIGS. 6A to 16. FIGS. 6A and 6B show a top view and a bottom view of the upper housing according to the present embodiment. FIG. 7 shows a top view inside the cylinder head according to the present embodiment. FIG. 8 is a cross-sectional view showing the cylinder head taken along a line A-A in FIG. 7. FIG. 9 is a cross-sectional view showing the cylinder head taken along a line B-B in FIG. 8. FIG. 10 is a cross-sectional view showing the cylinder head taken along a line C-C in FIG. 7. FIG. 11 is a cross-sectional view showing the cylinder head taken along a line D-D in FIG. 7. FIG. 12 is a cross-sectional view showing the cylinder head taken along a line E-E in FIG. 7. FIG. 13 is a cross-sectional view showing the cylinder head taken along a line F-F in FIG. 8. FIG. 14 is a cross-sectional view showing the cylinder head taken along a line G-G in FIG. 13. FIG. 15 is a cross-sectional view showing the cylinder head taken along a line H-H in FIG. 7. FIG. 16 is a cross-sectional view showing the cylinder head taken along a line I-I in FIG. 7.

As shown in FIG. 6A and FIG. 6B, the upper housing 49 is formed in a ladder shape by housing fixing portions 81*a* and 81*b* extending in a front-rear direction and first to third bridge portions 82 to 84 extending in a left-right direction. The housing fixing portions 81*a* and 81*b* are fixed to the cam housings 42*a* and 42*b* (see FIG. 3). The first bridge portion 82 couples the housing fixing portions 81*a* and 81*b* on an intake side of the cylinder head 23. The second bridge portion 83 couples the housing fixing portions 81*a* and 81*b* between the intake side and an exhaust side of the cylinder head 23. The third bridge portion 84 couples the housing fixing portions 81*a* and 81*b* on the exhaust side of the cylinder head 23.

The first bridge portion 82 extends along the intake rocker shaft 47 (see FIG. 3), and a lubrication passage 93*i* (see FIG. 11) through which lubrication oil passes is formed in the first bridge portion 82. A plurality of (five in the present embodiment) injection holes 94*b* are formed in a lower surface of the first bridge portion 82, and the plurality of injection holes 94*b* are positioned above contact portions with components of the switching mechanism 50. A pair of nozzles 91 protrude from the first bridge portion 82 toward the intake side, and injection holes 94*c* at tip ends of the pair of nozzles 91 are positioned above the pair of intake valves 31 (see FIG. 3). The first bridge portion 82 is coupled to the housing fixing portions 81*a* and 81*b* via coupling portions 86*a* and 86*b*.

The hydraulic chamber 87 (see FIG. 5) is formed in the coupling portion 86*a* which is a coupling portion between the first bridge portion 82 and the housing fixing portion 81*a*. The storage chamber 88 (see FIG. 5) is formed in the coupling portion 86*b* which is a coupling portion between the first bridge portion 82 and the housing fixing portion 81*b*. The hydraulic piston 53 (see FIG. 5) is installed in the hydraulic chamber 87, and the spring pin 54 (see FIG. 5) is installed in the storage chamber 88. The hydraulic chamber 87 and the storage chamber 88 are formed coaxially, and parallelism between the hydraulic piston 53 and the spring pin 54 is ensured. Hydraulic oil is supplied to the hydraulic chamber 87 through a hydraulic circuit different from that of lubrication oil.

The second bridge portion 83 extends along the camshaft 41 (see FIG. 3), and a lubrication passage 93*s* (see FIG. 16) is formed in the second bridge portion 83. A plurality of injection holes 94*f* are formed in a lower surface of the second bridge portion 83, and the plurality of injection holes 94*f* are positioned above the rocker arms 35*a*, 35*b*, and 37. The third bridge portion 84 extends along the exhaust rocker shaft 48 (see FIG. 3). A pair of nozzles 92 protrude from the third bridge portion 84 toward the exhaust side, and injection holes 94*d* at tip ends of the pair of nozzles 92 are positioned above the pair of exhaust valves 33 (see FIG. 3).

An oil hole 89 is formed on the intake side of the housing fixing portion 81*a*, and hydraulic oil is supplied from the oil control valve 60 to the oil hole 89. An oil groove is formed in a lower surface of the housing fixing portion 81*a*, and the actuation passage 71 and the direct passage 74 through which hydraulic oil passes are formed by fixing the housing fixing portion 81*a* to the cam housing 42*a*. The actuation passage 71 and the direct passage 74 communicate with the hydraulic chamber 87 in which the hydraulic piston 53 is installed, and hydraulic oil is supplied from the oil control valve 60 to the hydraulic chamber 87 through the actuation passage 71 and the direct passage 74.

An oil groove is formed in a lower surface of the housing fixing portion 81*a*, and a lubrication passage 93*q* is formed by fixing the housing fixing portion 81*a* to the cam housing 42*a*. Lubrication oil is fed from the lubrication passage 93*q* to the lubrication passage 93*s* of the second bridge portion 83. An oil groove is formed in a lower surface of the housing fixing portion 81*b*, and a lubrication passage 93*g* is formed by fixing the housing fixing portion 81*b* to the cam housing 42*b*. Lubrication oil is fed from the lubrication passage 93*g* to the lubrication passage 93*i* of the first bridge portion 82. In this manner, a hydraulic circuit for lubrication oil and hydraulic oil is formed in the upper housing 49.

As shown in FIGS. 7 to 9, the cylinder head 23 is fixed to the crankcase 21 via the cylinder 22 by a plurality of head bolts 79. A gap between the head bolt 79 on the exhaust side and a bolt hole serves as a lubrication passage 93*a*, and a lubrication passage 93*b* extends obliquely from the lubrication passage 93*a* to the camshaft 41. Lubrication oil is guided from the crankcase 21 to a lubrication groove 93*c* around the camshaft 41 through the lubrication passages 93*a* and 93*b*. A lubrication path 90*a* leading to the switching mechanism 50 and a lubrication path 90*b* leading to the rocker arms 35*a*, 35*b*, and 37 are divided from the lubrication groove 93*c* around the camshaft 41.

First, the lubrication path 90*a* will be described. The housing fixing portion 81*a* at the center in the left-right direction is fixed to the cylinder head 23 via the cam housing 42*a* by a pair of housing bolts 95*a*. A gap between the housing bolt 95*a* on the intake side and a bolt hole serves a lubrication passage 93*d* extending from the lubrication groove 93*c* around the camshaft 41 to the intake rocker shaft 47. Lubrication oil is guided from the lubrication passage 93*d* to a lubrication passage 93*e* in the intake rocker shaft 47, and the lubrication oil flows from one end to the other end of the lubrication passage 93*e*. A plurality of supply holes 94*a* are provided in the lubrication passage 93*e* in the intake rocker shaft 47, and the lubrication oil is supplied from the supply holes 94*a* to shaft holes of the intake rocker arms 35*a* and 35*b*. The supply holes 94*a* are not open to the atmosphere.

As shown in FIGS. 7 and 10, the housing fixing portion 81*b* on an outer side in the left-right direction is fixed to the cylinder head 23 via the cam housing 42*b* by a pair of housing bolts 95*b*. A gap between the housing bolt 95*b* on the intake side and a bolt hole serves as a lubrication passage 93*f* extending from an end portion of the lubrication passage 93*e* in the intake rocker shaft 47 to the housing fixing portion 81*b*. A lubrication passage 93*h* extends obliquely from the lubrication passage 93*g* on a mating surface between the housing fixing portion 81*b* and the cam housing 42*b* to the first bridge portion 82. The lubrication passage 93*i* is formed in the first bridge portion 82, lubrication oil is guided from the lubrication passage 93*h* to the lubrication passage 93*i*, and the lubrication oil flows from the other end to one end of the lubrication passage 93*i*.

As shown in FIGS. 7 and 11, the lubrication passage 93*i* is provided with five injection holes 94*b* opened to the atmosphere. The injection holes 94*b* are positioned above contact portions with the hydraulic piston 53, the coupling pin 51, the return pin 52, and the spring pin 54. Lubrication oil is injected from the injection holes 94*b* to the contact portions with these components. As shown in FIGS. 7 and 12, the pair of nozzles 91 protrude from the first bridge portion 82 to the intake side, and each nozzle 91 is formed with an injection hole 94*c* opened to the atmosphere. The injection hole 94*c* faces an inner wall surface of the cylinder head cover 24, and lubrication oil sprayed from the injection hole 94*c* to the inner wall surface is supplied to stem ends of the pair of intake valves 31 along the inner wall surface.

Next, the lubrication path 90*b* will be described. As shown in FIGS. 8 and 13, below the cam housing 42*a* at the center in the left-right direction, a lubrication passage 93*j* extends from the lubrication groove 93*c* around the camshaft 41 toward an inner side of the camshaft 41. Lubrication oil is guided from the lubrication passage 93*j* to a lubrication passage 93*k* in the camshaft 41, and the lubrication oil flows to the outside in the left-right direction from the center of the lubrication passage 93*k* in the left-right direction. An outlet of the lubrication passage 93*j* is provided at the center in the left-right direction of the lubrication passage 93*k* below the cam housing 42*a*, and an inlet of a lubrication passage 931 is provided on an outer side in the left-right direction of the lubrication passage 93*k* below the cam housing 42*b*.

As shown in FIGS. 13 and 14, below the cam housing 42*b* on an outer side in the left-right direction, lubrication oil is guided from the lubrication passage 931 to a lubrication groove 93*m* around the camshaft 41. A gap between the housing bolt 95*b* on the exhaust side and a bolt hole serves as a lubrication passage 93*n* extending from the lubrication groove 93*m* around the camshaft 41 to the exhaust rocker shaft 48. A pair of nozzles 92 (see particularly FIG. 7) protrude from the third bridge portion 84, and each nozzle 92 is formed with an injection hole 94*d* that communicates with the lubrication passage 93*n* and is open to the atmosphere. Each injection hole 94*d* faces a rib 96 of the cylinder head cover 24 (see FIG. 12), and lubrication oil sprayed from the injection hole 94*d* to the rib 96 is supplied to stem ends of the pair of exhaust valves 33 along the rib 96.

As shown in FIGS. 9 and 14, lubrication oil is guided from the lubrication passage 93*n* to a lubrication passage 930 in the exhaust rocker shaft 48, and the lubrication oil flows from the other end to one end of the lubrication passage 930. A plurality of supply holes 94*e* are provided in the lubrication passage 930 in the exhaust rocker shaft 48, and lubrication oil is supplied from the supply holes 94*e* to a shaft hole of the exhaust rocker arm 37. The supply holes 94*e* are not open to the atmosphere. In this manner, the lubrication path 90*b* is folded back by the lubrication passage 93*k* in the camshaft 41 and the lubrication passage 930 in the exhaust rocker shaft 48. A gap between the exhaust side housing bolt 95*a* on an outlet side of the lubrication passage 930 and a bolt hole serves as a lubrication passage 93*p* (see FIG. 15).

As shown in FIGS. 15 and 16, a lubrication passage 93*r* extends obliquely from the lubrication passage 93*q* of a mating surface between the housing fixing portion 81*a* and the cam housing 42*a* toward the second bridge portion 83. Lubrication oil is guided from the lubrication passage 93*r* to the lubrication passage 93*s* in the second bridge portion 83, and the lubrication oil flows from one end to the other end of the lubrication passage 93*s*. The lubrication passage 93*s* is provided with three injection holes 94*f* opened to the atmosphere. The injection holes 94*f* are positioned above the intake rocker arms 35*a* and 35*b* and the exhaust rocker arm 37. Lubrication oil is injected from the injection holes 94*f* to the rocker arms 35*a*, 35*b*, and 37.

In this manner, lubrication oil is pressure-fed from the lubrication groove 93*c* around the camshaft 41 toward the injection holes 94*b* to 94*d* and 94*f*. The lubrication path 90*a* enables lubrication oil to flow from the lubrication groove 93*c* to the injection holes 94*b* and 94*c* through the lubrication passages 94*d* to 93*i*. The lubrication path 90*b* enables lubrication oil to flow from the lubrication groove 93*c*, pass through the lubrication passages 93*j* and 93*k*, and pass through the lubrication groove 93*m*, and then flow from the lubrication groove 93*m*, pass through the lubrication passages 93*n* to 93*s*, and flow to the injection holes 94*d* and 94*f*. A passage length of the lubrication path 90*b* from the lubrication groove 93*c* to the injection hole 94*f* is formed to be larger than a passage length of the lubrication path 90*a* from the lubrication groove 93*c* to the injection holes 94*b* and 94*c*, so that oil pressure in the lubrication passage 93*i* and the injection holes 94*b* and 94*c* is increased.

As described above, the upper housing 49 is formed with five injection holes 94*b* for the switching mechanism 50, two injection holes 94*c* for the stem ends of the intake valves 31, two injection holes 94*d* for the stem ends of the exhaust valves 33, and three injection holes 94*f* for the rocker arms 35*a*, 35*b*, and 37. The number of the injection holes 94*b* and 94*c* of the lubrication path 90*a* is larger than the number of the injection holes 94*d* and 94*f* of the lubrication path 90*b*. Since the number of the injection holes 94*d* and 94*f* on the lubrication path 90*b* side is reduced, it is possible to increase a supply amount of lubrication oil to the injection holes 94*b* for the switching mechanism 50 having many portions to be lubricated on the lubrication path 90*a* side.

All of the injection holes 94*b* to 94*d* and 94*f* in the upper housing 49 are formed to have the same diameter, so that the injection holes 94*b* to 94*d* and 94*f* can be easily formed in the upper housing 49. Supply amounts of lubrication oil on the lubrication path 90*a* side and on the lubrication path 90*b* side are easily adjusted by adjusting a passage length. The injection holes 94*b* and 94*c* are provided in the same lubrication passage 93*i*, and the injection holes 94*b* and 94*c* are installed compactly on the intake side of the engine 20. The injection hole 94*d* is provided in the lubrication passage 930 upstream of the injection hole 94*f*, and a supply amount of lubrication oil from the injection hole 94*f* to the rocker arms 35*a*, 35*b*, and 37 is adjusted according to a position of the injection hole 94*d*.

The lubrication passage 93*e* in the intake rocker shaft 47 is coupled in series to the lubrication passage 93*i* in the first bridge portion 82, and lubrication oil flows in one direction from the lubrication groove 93*c* toward the injection holes 94*b* and 94*c* through the lubrication passages 93*e* and 93*i*. The lubrication passage 930 in the exhaust rocker shaft 48 is coupled in series to the lubrication passage 93*s* in the second bridge portion 83, and lubrication oil flows in one direction toward the injection holes 94*d* and 94*f* through the lubrication passages 930 and 93*s*. Since flow directions of lubrication oil in the lubrication paths 90*a* and 90*b* are the one direction, the number of branches of passages is reduced, and an amount of the lubrication oil is easily controlled.

The lubrication passage 93*i* is positioned above the lubrication passage 93*e*, and the lubrication passage 93*s* is positioned above the lubrication passage 930. Even when the number of passages increases, the lubrication passages are made compact. As shown in FIG. 2, the lubrication passage 93*i* is positioned at the highest position H1, the lubrication passage 93*s* is positioned at a second highest position H2, the lubrication passage 93*e* is positioned at a third highest position H3, and the lubrication passage 930 is positioned at a lowest position H4. The injection hole 94*b* in the lubrication passage 93*i* is positioned higher than the injection hole 94*f* in the lubrication passage 93*s*. Even when the switching mechanism 50 is positioned high, lubrication oil can be appropriately injected to the switching mechanism 50 by the injection of lubrication oil from the injection hole 94*b*.

As described above, according to the variable valve device 40 in the present embodiment, since a passage length from the lubrication groove 93*c* around the camshaft 41 to the injection hole 94*f* for the rocker arms 35*a*, 35*b*, and 37 is longer than a passage length from the lubrication groove 93*c* to the injection hole 94*b* for the switching mechanism 50, oil pressure in a lubrication passage provided with the injection hole 94*b* is increased. Even when the number of components to be lubricated is increased due to the switching mechanism 50, an appropriate amount of lubrication oil is injected from the injection holes 94*b* to the switching mechanism 50, and an appropriate amount of lubrication oil is injected from the injection holes 94*f* to the rocker arms 35*a*, 35*b*, and 37. Therefore, components of the switching mechanism 50 and the rocker arms 35*a*, 35*b*, and 37 are appropriately lubricated.

In the present embodiment, the variable valve device includes a pair of intake rocker arms. Alternatively, the variable valve device may include three or more intake rocker arms.

In the present embodiment, the upper housing is formed with five injection holes for the switching mechanism and three injection holes for the rocker arms, and the injection holes are formed to have the same diameter. Alternatively, the number and sizes of the injection holes are not limited as long as a total area of the injection holes for the switching mechanism is larger than a total area of the injection holes for the rocker arms.

In the present embodiment, the upper housing includes the first to third bridge portions. Alternatively, the upper housing may be formed to be supported at both ends on upper surfaces of a pair of cam housings.

Although a seesaw type rocker arm is described as an example in the present embodiment, the type of the rocker arm is not particularly limited, and a finger follower type rocker arm may be used.

Although a plurality of rocker arms are adjacent to one another in the present embodiment, the plurality of rocker arms may be separated from one another.

Further, the variable valve device according to the present embodiment is not limited to being used in an engine of a straddle-type vehicle described above, and may be used in an engine of another type of vehicle. The straddle-type vehicle is not limited to a motorcycle, and may be any vehicle on which an engine is mounted. The straddle-type vehicle is not limited to a general vehicle in which a driver rides on a seat in a posture straddling the seat, and includes a scooter-type vehicle in which a driver rides on a seat without straddling the seat.

As described above, according to a first aspect, a variable valve device (40) is configured to change a valve operation in a cylinder head (23), the variable valve device includes a pair of cam housings (42*a* and 42*b*) separated from each other in a predetermined direction in the cylinder head, a camshaft (41) supported by the cylinder head and the pair of cam housings, a pair of rocker shafts (the intake rocker shaft 47 and the exhaust rocker shaft 48) supported by opposing portions of the pair of cam housings, a plurality of rocker arms (the intake rocker arms 35*a* and 35*b* and the exhaust rocker arm 37) supported by the pair of rocker shafts in a swingable manner, a switching mechanism (50) that couples and separates intake arms among the plurality of rocker arms, and an upper housing (49) supported at both ends on upper surfaces of the pair of cam housings, in which the upper housing is formed with a first injection hole (the injection hole 94*b*) for supplying lubrication oil to the switching mechanism and a second injection hole (the injection hole 94*f*) for supplying lubrication oil to the plurality of rocker arms, and the lubrication oil is pressure-fed from a lubrication groove (93*c*) around the camshaft to the first injection hole and the second injection hole, and a passage length from the lubrication groove to the second injection hole is larger than a passage length from the lubrication groove to the first injection hole. According to this configuration, since the passage length from the lubrication groove around the camshaft to the second injection hole is larger than the passage length from the lubrication groove to the first injection hole, oil pressure in a lubrication passage provided with the first injection hole on the switching mechanism side is increased. Even when the number of components to be lubricated is increased due to the switching mechanism, an appropriate amount of lubrication oil is injected from the first injection hole to the switching mechanism, and an appropriate amount of lubrication oil is injected from the second injection hole to the plurality of rocker arms. Therefore, components of the switching mechanism and the rocker arms are appropriately lubricated.

According to a second aspect, in the first aspect, the pair of rocker shafts are an intake rocker shaft and an exhaust rocker shaft, the lubrication oil is pressure-fed to the first injection hole from the lubrication groove through an inner side of the intake rocker shaft, and the lubrication oil is pressure-fed to the second injection hole from the lubrication groove through an inner side of the camshaft and then through an inner side of the exhaust rocker shaft. According to this configuration, a passage length can be easily adjusted by using inner sides of existing components of the intake rocker shaft, the exhaust rocker shaft, and the camshaft as lubrication passages.

According to a third aspect, in the first aspect or the second aspect, the upper housing is formed with more first injection holes than the second injection holes. According to this configuration, by reducing the second injection holes on the rocker arm side, it is possible to increase a supply amount of lubrication oil supplied to the first injection holes for the switching mechanism having many portions to be lubricated.

According to a fourth aspect, in any one of the first aspect to the third aspect, the upper housing is formed with a third injection hole (the injection hole 94*c*) for supplying lubrication oil to a stem end of an intake valve (31) and a fourth injection hole (the injection hole 94*d*) for supplying lubrication oil to a stem end of an exhaust valve (33), and the first injection hole and the third injection hole are provided in the same lubrication passage, and the fourth injection hole is provided in a lubrication passage upstream of the second injection hole. According to this configuration, the first injection hole and the third injection hole can be formed compactly in the same lubrication passage, and a supply amount of lubrication oil from the second injection hole to the rocker arms can be adjusted according to a position of the fourth injection hole.

According to a fifth aspect, in any one of the first aspect to the fourth aspect, the first injection hole and the second injection hole are formed to have the same diameter. According to this configuration, a supply amount of the lubrication oil is easily adjusted by a passage length. Further, the injection holes can be easily formed in the upper housing.

According to a sixth aspect, in any one of the first aspect to the fifth aspect, the first injection hole is positioned higher than the second injection hole. According to this configuration, even when the switching mechanism is positioned high, the switching mechanism can be appropriately lubricated by the injection of the lubrication oil from the first injection hole.

According to a seventh aspect, in any one of the first aspect to the sixth aspect, the pair of rocker shafts are an intake rocker shaft and an exhaust rocker shaft, the upper housing is formed with a first lubrication passage (the lubrication passage 93*i*) provided with the first injection hole and a second lubrication passage (the lubrication passage 93*s*) provided with the second injection hole, the intake rocker shaft is formed with a third lubrication passage (the lubrication passage 93*e*) that is coupled in series to the first lubrication passage, and the exhaust rocker shaft is formed with a fourth lubrication passage (the lubrication passage 930) that is coupled in series to the second lubrication passage, and the first lubrication passage is positioned above the third lubrication passage, and the second lubrication passage is positioned above the fourth lubrication passage. According to this configuration, the lubrication passage can be made compact even when the number of passages increases. Since the first lubrication passage and the third lubrication passage are coupled in series and the second lubrication passage and the fourth lubrication passage are coupled in series, lubrication oil flows in one direction from the lubrication groove toward a first supply hole and a second supply hole, and an amount of the lubrication oil is easily controlled.

Although the present embodiment has been described, a part or all of the embodiment and modifications described above may be combined as another embodiment.

The technique according to the present invention is not limited to the embodiment described above, and may be variously changed, replaced, or modified without departing from the gist of the technical concept. Further, the present invention may be implemented by other methods as long as the technical concept can be implemented by the methods through advance of the technique or other derivative techniques. Therefore, the claims cover all embodiments that may fall within the scope of the technical concept.

The invention claimed is:

1. A variable valve device configured for adjusting a valve operation in a cylinder head, the variable valve device comprising:

a pair of cam housings separated from each other in the cylinder head;

a camshaft supported by the cylinder head and the pair of cam housings;

a pair of rocker shafts supported by opposing portions of the pair of cam housings;

a plurality of rocker arms pivotally supported by the pair of rocker shafts, the plurality of rocker arms including a first intake rocker arm, a second intake rocker arm, and an exhaust rocker arm;

a switching mechanism configured to selectively couple the first intake rocker arm to the second intake rocker arm; and an upper housing including:

a first end and a second end respectively supported on upper surfaces of the pair of cam housings, a first injection hole configured to supply lubrication oil to the switching mechanism, and a second injection hole configured to supply the lubrication oil to the plurality of rocker arms, wherein the lubrication oil is pressure-fed from a lubrication groove formed around an outer surface of the camshaft to the first injection hole and the second injection hole such that a passage length from the lubrication groove to the second injection hole is greater than a passage length from the lubrication groove to the first injection hole, and wherein a hydraulic circuit configured to actuate the switching mechanism is different from a hydraulic circuit of the lubrication oil.

2. The variable valve device according to claim 1, wherein:

the pair of rocker shafts includes an intake rocker shaft and an exhaust rocker shaft, the lubrication oil is pressure-fed to the first injection hole from the lubrication groove through an inner side of the intake rocker shaft, and the lubrication oil is pressure-fed to the second injection hole from the lubrication groove through an inner side of the camshaft and then through an inner side of the exhaust rocker shaft.

3. The variable valve device according to claim 1, wherein:

the upper housing further includes a plurality of the first injection holes and a plurality of the second injection holes such that a number of the first injection holes is greater than a number of the second injection holes.

4. The variable valve device according to claim 1, wherein:

the upper housing further includes a third injection hole for supplying configured to supply the lubrication oil to a stem end of an intake valve, and a fourth injection hole configured to supply the lubrication oil to a stem end of an exhaust valve, and the first injection hole and the third injection hole are provided in a same lubrication passage, and the fourth injection hole is provided in a lubrication passage upstream of the second injection hole.

5. The variable valve device according to claim 1, wherein:

a diameter of the first injection hole is equal to a diameter of the second injection hole.

6. The variable valve device according to claim 1, wherein:

the first injection hole is positioned higher than the second injection hole.

7. The variable valve device according to claim 1, wherein:

the pair of rocker shafts includes an intake rocker shaft and an exhaust rocker shaft, the first injection hole is formed in a first lubrication passage of the upper housing, and the second injection hole is formed in a second lubrication passage of the upper housing, the intake rocker shaft includes a third lubrication passage coupled in series to the first lubrication passage, and the exhaust rocker shaft includes a fourth lubrication passage coupled in series to the second lubrication passage, and the first lubrication passage is positioned above the third lubrication passage, and the second lubrication passage is positioned above the fourth lubrication passage.

* * * * *